United States Patent [19]

Steinwart et al.

[11] 4,215,538

[45] Aug. 5, 1980

[54] INTERNAL COMBUSTION ENGINE HAVING AN AFTERBURNING DEVICE

[75] Inventors: Johannes Steinwart, Obersulm-Willsbach; Konrad Lummerzheim, Neckargartach; Armin Bauder, Neckarsulm; Gottlieb Wilmers, Neuenstadt, all of Fed. Rep. of Germany

[73] Assignee: Audi NSU Auto Union Aktiengesellschaft, Neckarsulm, Fed. Rep. of Germany

[21] Appl. No.: 922,283

[22] Filed: Jul. 6, 1978

[30] Foreign Application Priority Data

Jul. 9, 1977 [DE] Fed. Rep. of Germany ..... 2731098

[51] Int. Cl.[2] ..... F01N 3/15

[52] U.S. Cl. ..... 60/276; 60/288; 60/302; 60/901; 123/193 H

[58] Field of Search ..... 60/324, 277, 288, 284, 60/276, 901, 302; 123/193 H

[56] References Cited

U.S. PATENT DOCUMENTS

| | | | |
|---|---|---|---|
| 3,579,981 | 5/1971 | Gau | 60/324 |
| 3,670,502 | 6/1972 | Firey | 60/324 |
| 3,808,806 | 5/1974 | Nakamura | 60/288 |
| 3,963,447 | 6/1976 | Hayashi | 60/288 |
| 3,972,184 | 8/1976 | Warren | 60/288 |

*Primary Examiner*—Douglas Hart

*Attorney, Agent, or Firm*—Kane, Dalsimer, Kane, Sullivan and Kurucz

[57] ABSTRACT

An internal combustion engine has at least one outlet passage for exhausting the burned gases, terminating at the exterior surface of the engine, and, alternatively, connectable to the afterburning device or to a by-pass line by-passing the afterburning device. A control regulated as a function of temperature is provided to direct the burned gases through the by-pass line at high temperature and through the afterburning device at low temperature.

14 Claims, 13 Drawing Figures

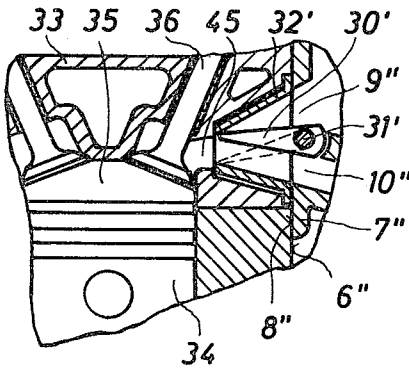
Fig. 4
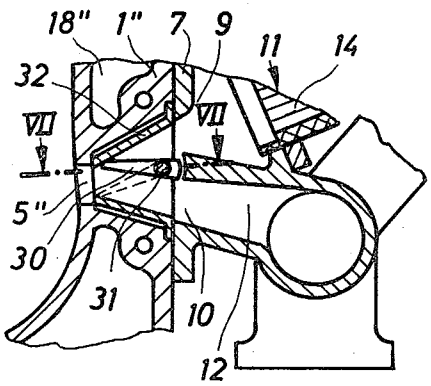
Fig. 3
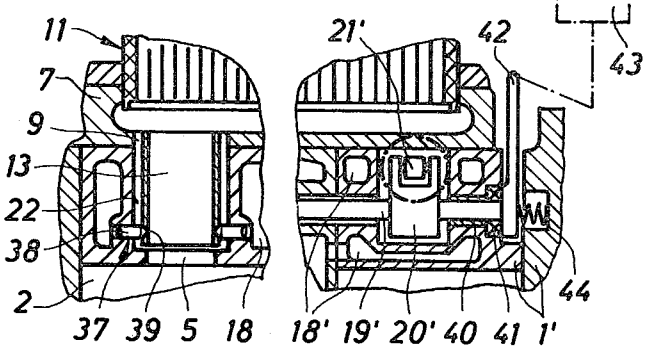
Fig. 6
Fig. 5
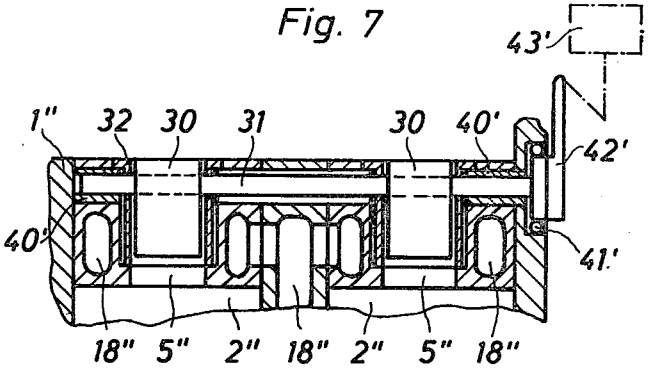
Fig. 7
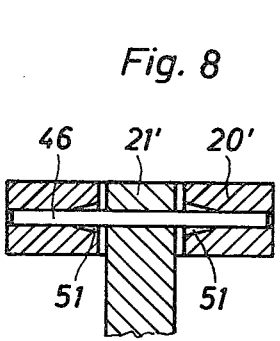
Fig. 8
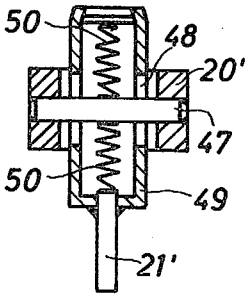
Fig. 9

INTERNAL COMBUSTION ENGINE HAVING AN AFTERBURNING DEVICE

BACKGROUND OF THE INVENTION

It is known to arrange an afterburning device as close as possible to the engine to provide the gases with no opportunity to cool on the way to the afterburner, especially in a cold start. The primary purpose of this proposal is to have the afterburning of the exhaust established promptly after the cold start. This arrangement is especially important after a cold start, when the engine is still comparatively cool, because the exhaust gases contain a large proportion of noxious constitutents in this particular operating mode. After operating temperature has been reached, when the noxious constitutents in the exhaust diminish, since the thermal load capacity of the afterburning device is generally low, the exhaust flow is passed for the most part through the by-pass line by means of a control actuated in response to heating and usually arranged in the by-pass line.

To a known afterburning system, (see German DT OS No. 2,360,581) a throttling flap alternately opens and closes the by-pass line and the exhaust line to the afterburner, to avoid continuing to expose the afterburner to the hot exhaust even when the flow is being carried by the by-pass line and thus shortening its life. However, not only does such a flap in each case set transverse to the exhaust flow, adversely affect the flow of exhaust gas, but also a considerable distance must be kept between the engine and the afterburner for the installation of the flap, so that after a cold start the heating time of the afterburner is undesirably prolonged and the afterburning of the exhaust occurs correspondingly late. Besides, the exhaust ducts leading to the afterburner, as well as the by-pass line, are seriously affected by engine vibration, which tends to cause early failure thereof.

SUMMARY OF THE INVENTION

The principal object of the invention is to provide an internal combustion engine with an afterburner which effectively eliminates the foregoing disadvantages and achieves prompt initiation of afterburning.

These and other objects of the invention are accomplished by providing a housing on the exterior surface of the engine near the outlet passage. This housing includes openings facing the engine, one of which openings is connected directly to the afterburner and the other to the by-pass line. The outlet passage widens in the direction of flow towards the exterior surface so that it encloses the openings. A control member in the outlet passage is pivotal so that it connects the outlet passage exclusively with one opening in a first position and, exclusively, with the other opening in the second position.

While this arrangement, including the installation of a control member protecting the afterburner system from direct exposure to operating temperatures, a compact design and an extremely short exhaust gas travel into the afterburner is achieved, and, consequently, the afterburner system will warm up as quickly as possible. In addition, the contemplated arrangement of the afterburner requires less space than any other known arrangement. The placement of the afterburner immediately adjacent to the engine also eliminates duct work connecting the engine to the afterburner as in known devices, which ducts frequently foil under vibration.

Also, the exhaust gases can flow into the afterburner or into the by-pass by way of the corresponding opening without overcoming any flow resistance and without any substantial change in direction of flow.

According to the present invention the control member may consist of a tubular insert. The use of such an insert has the advantage that it will be heated faster by the hot exhaust flowing rather than the wall of the outlet duct, and thus, especially after a cold start, contribute to rapid combustion of the noxious constitutents. Besides, the exhaust is prevented from being cooled by the wall of the outlet passage in this mode.

Alternatively, however, the control member may consist of a flap mounted between the two openings while extending into the outlet passage. A flap of this nature can likewise guide the exhaust flow leaving the engine into one opening or the other without any flow resistance. In this modification, a tubular, but fixed, insert may also be provided in the outlet passage, suitably enlarged in the region of the flap to maintain the proper port area.

In another embodiment, the control member may be a rotary slide mounted in the engine housing between the two openings. This alternative, comparatively large port areas can be utilized in this arrangement to enhance very favorable flow conditions for the exhaust.

The tubular insert may be mounted on conical bearings at its pivot and be connected at a distance from the pivot to a linkage capable of being actuated by a shaft mounted in the engine housing by way of a lever. In this arrangement, there are very few points of contact between the insert and the outlet passage, thus further improving the heat insulation of the control member from its surroundings and preventing the control from jamming, while the actuating mechanism is exposed to comparatively slight heat action.

The flap may be fixed on a shaft mounted in the engine housing. Alternatively, however, the flap may be fixed on a shaft mounted in the housing adjacent to the exterior surface of the engine. Its arrangement in the engine housing provides a more compact design, while its arrangement in the adjacent housing permits easier assembly.

The linkage and/or the shaft may be arranged in the region of the cooling jacket of the engine, further limiting the exposure of the actuating means to heat. If the shaft is arranged above the tubular insert, this will largely prevent dirt from collecting in the space around the parts of the actuating system and fouling it, as the dirt can simply drop out in this proposed modification.

The connection between the lever and the linkage may consist of a spring element. This serves the purpose that the linkage connected to the insert will not be actuated until some slack has been taken up. In this manner, the tubular insert can be broken loose from any cracked deposit should the the actuating system be rigidly coupled to a power drive. However, the spring element may also serve to absorb tolerances in the actuating system and maintain each insert in reliable contact in a multiple insert arrangement.

The spring element may, for example, consist of a spring bolt connected at both ends to the lever or the linkage and in the middle to the linkage or the lever as the case may be. Alternatively, a spring connection can be established by connecting the lever to the linkage by way of a pin guided in an oblong hole and bearing upon the ends of the oblong hole by way of a spring element arranged in each end of the hole.

To avoid cooling of exhaust gases entering the afterburner along the walls of the housing, the housing containing the afterburner may be fitted between one opening and the afterburner with an insulating insert forming a cavity with the wall of the housing. As was the case with the tubular insert arranged in the outlet passage, this insulating insert can be heated very quickly by the exhaust flowing past, and thus contribute to rapid combustion of noxious exhaust constituents. At the same time, loss of heat to housing parts not yet warm immediately after a cold start can be reduced.

In the housing containing the afterburner, between the opening and the afterburner, a baffle directed at the center of the afterburner may be arranged. The baffle divides the afterburner system into two halves carrying flow in opposed directions, and bounding both the opening leading to the afterburner and the exhaust line opening into the by-pass from the second half of the afterburner. By this construction, the afterburner is enabled to carry forward and return flow, thus eliminating the exhaust line that would otherwise be required, from the outside of the afterburner back into the by-pass line. Furthermore, the resulting more compact afterburner will carry move intensive flow and therefore be heated more rapidly.

Since the openings to the afterburner and to the by-pass are located in direct proximity to the outlet passage of the engine, it is especially advantageous for the openings in the housing to be connected by a passage in which a lambda probe is arranged. The composition of the exhaust can thereby be sensed immediately after it leaves the engine, the lambda probe being constantly bathed in the passage.

Application of the control and afterburner device according to the invention is not limited to any particular type of internal combustion engine. For example, such an arrangement can be used in reciprocating piston as well as rotary piston engines alike.

BRIEF DESCRIPTION OF THE DRAWINGS

FIG. 3 shows a third embodiment in cross-section similar to FIG. 1, limited to the region of the outlet passage;

FIG. 4 shows a fourth embodiment in cross-section, illustrating a portion of the housing of an internal combustion engine in the form of a reciprocating piston engine having an outlet passage;

FIG. 5 shows a portion of a longitudinal section of the housing of a rotary piston internal combustion engine taken along the line V—V in FIG. 1;

FIG. 6 shows a portion of a longitudinal section of the housing of a rotary piston internal combustion engine taken along the line VI—VI in FIG. 2;

FIG. 7 shows a portion of a longitudinal section of the housing of a rotary piston internal combustion engine having two outlet passages with the adjacent housing of the afterburner omitted taken along the line VII—VII in FIG. 3;

FIG. 8 shows a portion of a first embodiment of the linkage in the circled region of FIG. 6 to a larger scale;

FIG. 9 shows a portion of a second embodiment of linkage;

DETAILED DESCRIPTION

Figure 1:
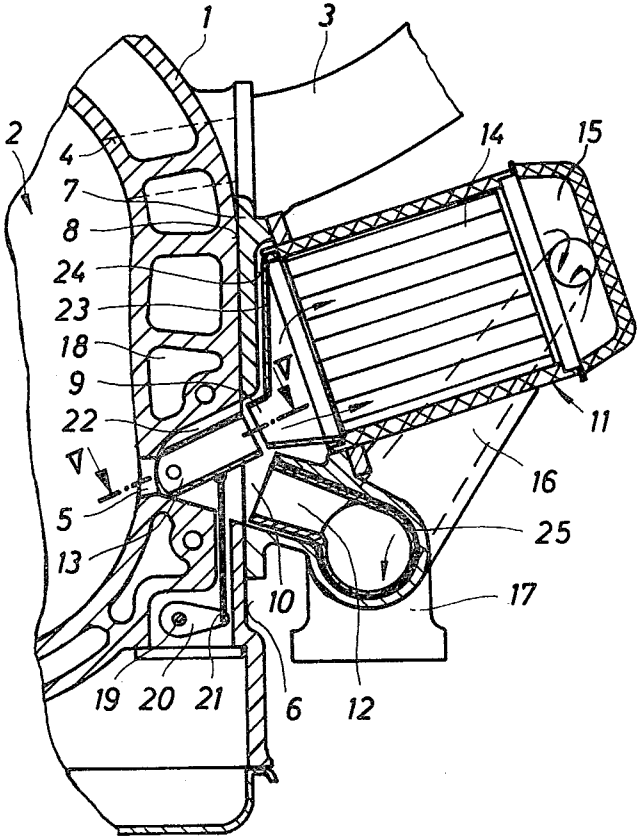
FIG. 1 shows a first embodiment of the invention in which a cross-section of a portion of the housing of an internal combustion engine in the form of a rotary piston engine has an outlet passage and includes an adjacent afterburner system.

Reference is made initially to FIG. 1. The engine shown, is in this embodiment by way of example, a rotary piston internal combustion engine having a housing 1 with a working chamber 2 in which the combustion process takes place. For this purpose, an intake duct 3 and an inlet passage 4 cooperate in supplying fresh gas and an outlet passage 5 exhaust the burned gases. The outlet passage 5 terminates at the exterior surface 6 of the housing 1 of the engine, adjoining which a housing 7 is arranged, having openings 9 and 10 in its surface of contact 8. The one opening 9 communicates directly with an afterburner 11 attached to the housing 7, and the other opening 10 with a by-pass 12 by-passing the afterburner 11. The outlet passage 5 is widened in the direction of flow towards the exterior surface 6 so as to enclose the openings 9 and 10. In the outlet passage 5, a temperature regulated control member is provided, consisting of a pivoted tubular insert 13 connecting the outlet passage 5 with the opening 10 and the adjoining by-pass 12 at high temperature, and with the opening 9 and afterburner 11 at low temperature. The afterburner 11 consists essentially of a reactor 14 and an adjoining chamber 15 connected by way of an exhaust line 16 to an exhaust manifold 17 into which the by-pass 12 opens as well. Further, the engine housing 1 has cavities 18 through which coolant flows in order to keep the engine heating due to the combustion process within certain limits. The tubular insert 13 is actuated by way of a shaft 19 mounted in housing 1 by a lever 20 and linkage 21 articulated thereto. To minimize the heat exposure of this actuating system, the shaft 19 and linkage 21 are arranged in the vicinity of the coolant carrying cavities 18.

In a cold start of the engine, the tubular insert occupies the position shown in FIG. 1 in which the exhaust flows through the insert 13 by way of opening 9 into the immediately adjoining afterburner 11. Thus, a very rapid heating of the afterburner and with it a rapid afterburning or reaction of the exhaust gases take place, so that the noxious constitutents contained in the exhaust are quickly removed when an engine is still comparatively cold. A more or less annular cavity 22 is formed between the pivoting insert 13 and the wall of the colder outlet passage 5, widening in the direction of flow. Accordingly, the insert 13 is thermally insulated from the outlet passage 5, and screened off to a large extent from the cold engine housing 1. Thus, direct contact of the exhaust, or of insert 13, with the wall (bathed with cold coolant) of outlet passage 5 is avoided, so that the heat held in insert 13 cannot be transferred directly to housing 1; and cooling of the exhaust is avoided. The insert 13 is moreover heated very rapidly, so that the noxious constituents borne by the exhaust can react on the insert 13 itself. In order to avoid the possibility that the exhaust entering housing 7 by way of opening 9 is cooled finally along the wall of housing 7, an additional insulating insert 23 is arranged between opening 9 and reactor 14 forming a space 24 with the wall of housing 7. This insulating insert 23, like the pivoted sheet 13, can be heated very quickly by the exhaust flowing past, thus contributing to rapid combustion of the noxious constituents. This compact arrangement and short travel of the exhaust very substantially accelerates the heating of the afterburner 11, and reduces conduction of heat to the housing parts which do not have time to become warm immediately after a cold start.

After operating temperature is reached, assuming further reaction of the exhaust is unnecessary, insert 13 is rotated from its first position into its second position, at opening 10, so that the exhaust flow is now carried off through opening 10 by way of by-pass 12 and exhaust manifold 17. In this second position, the reactor 14 is shielded from direct heat, thus suppressing further heating that might lead to destruction of the reactor 14. For additional heat insulation, the by-pass 12 may be lined with a tubular insert 25 if desired or necessary.

Figure 2:
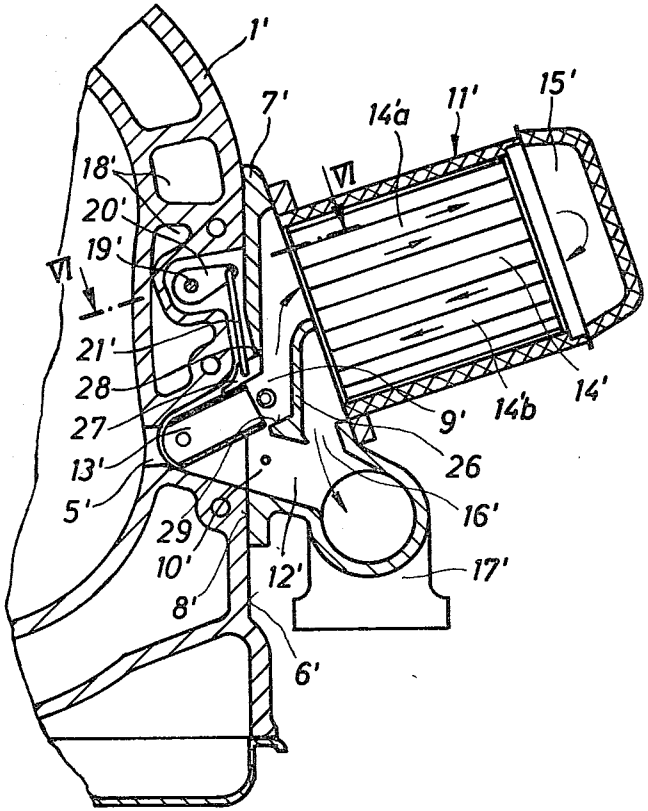
FIG. 2 shows a second embodiment in cross-section similar to FIG. 1.

In the exemplary embodiment of FIG. 2, the same numerals have been used as in FIG. 1, but marked with a prime for like and similar parts. In departing from the embodiment of FIG. 1, a baffle 26 is arranged in the housing 7', between opening 9' and the adjoining afterburner 11', and is directed at the center of the reactor 14 of afterburner 11'. This baffle 26 divides the afterburner 11' and/or reactor 14' into two halves 14'*a* and 14'*b* into opposite flow paths. Furthermore, the baffle 26 is so fashioned that it bounds both the opening 9' leading to the afterburner 11' and the exhaust line 16' opening into the by-pass 12' which communicates with both the second half 14'*b* of the afterburner 11, and the exhaust manifold 17'. In this extremely compact arrangement, the reactor 14', ordinarily of lamellar design, is still more intensively bathed and heated considerably faster, since the exhaust flow, as indicated by the arrows, first traverses the first half 14'*a*, then is reversed in the chamber 15', then traverses the second half 14'*b*, and is finally carried off by way of exhaust line 16' and manifold 17'. The insert 13' is actuated for example, by a linkage 21', the shaft 19' being arranged in housing 1' above insert 13' in a region exposed to considerably less heat because of its location in relation to the coolant carrying cavity 18' and the heat action of the combustion process. This arrangement has the further advantage that combustion residues will not lodge in the space in which lever 20' is arranged, but can drop out. To restrain vibration during operation, a stop 27 is arranged on insert 13' to fix the position of insert 13' at a surface of contact 28 in the first position and at a surface of contact 29 in the second position.

As may be seen in FIG. 3, where like parts are designated by the same numerals as in FIG. 1 and similar parts by the same numerals double primed, the control member consists instead of a pivoted flap 30 mounted between openings 9 and 10 and extending into the outlet passage 5. The flap 30 is fixed on a shaft 31 mounted in the engine housing 1''. In the position shown, corresponding to the operating mode when the engine is warm, the exhaust is directed through opening 10 into by-pass 12 without any flow resistance while opening 9 is covered and the afterburner 11 or reactor 14 cannot be affected. A tubular but fixed insert 32 is arranged in outlet passage 5'' and is widened to provide a sufficient port area for openings 9 and 10. Thus, conduction to housing 1'' is prevented when it has not yet heated immediately after a cold start, and cooling of the exhaust is avoided. When the flap 30 assumes the other position (shown dotted) a rapid heating of reactor 14 and prompt combustion of noxious exhaust constituents will take place.

The examplary embodiment of FIG. 4 where like and similar parts are designated by the same numerals as in FIG. 3, but singly or doubly primed, provides a partial view of the housing 33 of a reciprocating piston internal combustion engine having a piston 34, a working chamber 35, an outlet valve 36 and an outlet passage 45. The control member as in the embodiment of FIG. 3 consists of a pivoted flap 30' extending into the outlet passage 45 and fixed on a shaft 31'. The flap 30' is mounted, however, between openings 9'' and 10'' in the housing 7'' arranged on the exterior surface 6'' of the housing 33. The functions of the flap 30' and tubular insert 32' are otherwise the same as in the embodiment of FIG. 3.

FIG. 5 shows the arrangement of the pivots of insert 13 which include conical bearings 37 arranged near the entrance of the exhaust. As a result, the outlet passage 5 may be placed in communication with both openings 9 and 10. The conical bearing 37 consists in this example of points 38 fixed in the outlet passage 5 and sockets 39 on insert 13. Conical bearings have the advantage of minimal contact between insert 13 and outlet passage 5, and hence provide thorough heat insulation.

FIG. 6 shows the actuating system for insert 13', arranged in the vicinity of cavities 18' carrying coolant to reduce heat exposure. Shaft 19' is mounted in housing 1' on bearing 40 sealed where they emerge at the sides by gaskets 41 to prevent exhaust from leading through the bearing 40. On the emerging end of shaft 19' there is an actuating lever 42 held by a spring 44 against gasket 41 and actuated by a temperature control 43.

In the longitudinal section shown in FIG. 7, the arrangement of flaps 30, as in FIG. 3, is illustrated for two outlet passages 5''. The two flaps 30 are fixed directly on a common shaft 31 mounted in engine housing 1'' on bearings 40' and sealed from the outside by a gasket 41'. Shaft 31 is actuated by way of a lever 42', likewise actuated in turn by a temperature control 43'.

The examplary embodiment shown in FIG. 8 illustrates a spring element cooperating in connecting lever 20' (FIG. 6) to linkage 21'. The spring element consists essentially of a spring bolt 46 connected at its middle to linkage 21' and by its two ends to the arms of lever 20'. The engagement with the arms of lever 20' is opened out towards linkage 21' by recesses 51 to permit an elastic connection between lever 20' and linkage 21'. If for example the insert is stuck in the outlet passage, the linkage 21' is moved and actuated only after the slack of lever 20' has been taken up, so that the insert will be broken by the drive after it gets a start. Also, the elastic connection will compensate for dimensional errors in the actuating system.

The spring element in FIG. 9 performs the same function as that of the embodiment in FIG. 8. In this example, a pin 47 arranged between the arms of lever 20' is provided, and is guided in a sleeve 49 with oblong hole 48 in linkage 21'. On either side of pin 47, springs 50 are arranged in sleeve 49 against which the pin 47 will bear, thus making an elastic connection.

Figure 10:
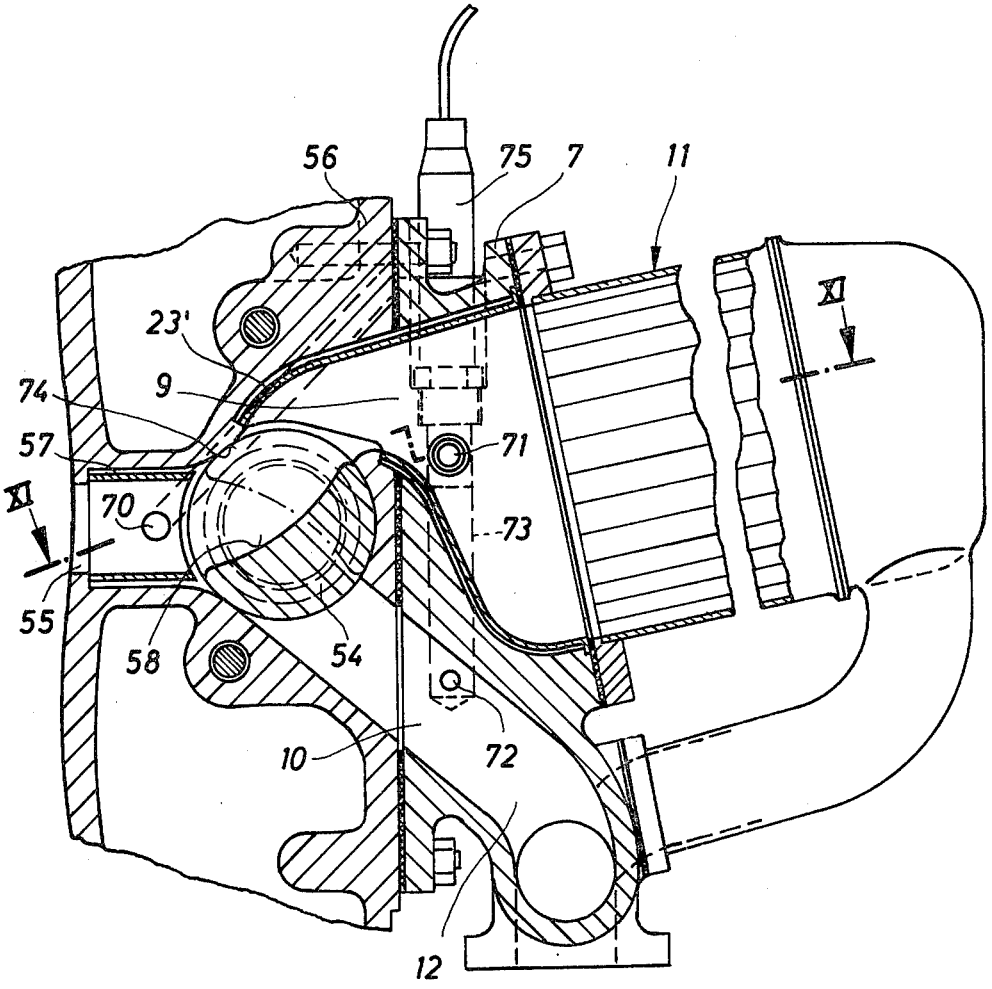
FIG. 10 shows a fifth embodiment of the invention in cross-section similar to FIG. 1 with an outlet passage therein.

As shown in FIG. 10, where like and similar parts are designated by the same numerals as in FIG. 1, the control member consists of a rotary slide 54 arranged between openings 9 and 10 on the one hand and outlet passage 55 on the other hand all in housing 56. The rotary slide 54 consists essentially of a cylindrical member having a cut-out serving as valve opening 58 and rotatably accommodated in a cylindrical aperture 74 of housing 56. Depending on the position of the rotary valve slide 54, the exhaust, as previously described, will be directed either through opening 9 into the afterburner 11 or through opening 10 into the by-pass 12. In the position shown, corresponding to the mode of operation after a cold start, the exhaust flow is guided through the valve opening 58 of rotary slide 54, approximately corresponding in size to the port area of the outlet passage 55, into the afterburner 11, arranged quite close to the engine. For heat insulation of the exhaust flow from the wall of housing 56, a fixed tubular insert 57 is arranged in outlet passage 5 and an insulating insert 23' in the housing 7 of afterburner 11 attached to the exterior surface of the engine housing 56. Insert 23' in this case extends considerably through opening 9 almost to rotary slide 54 to diminish the amount of heat conducted away.

Figure 11:
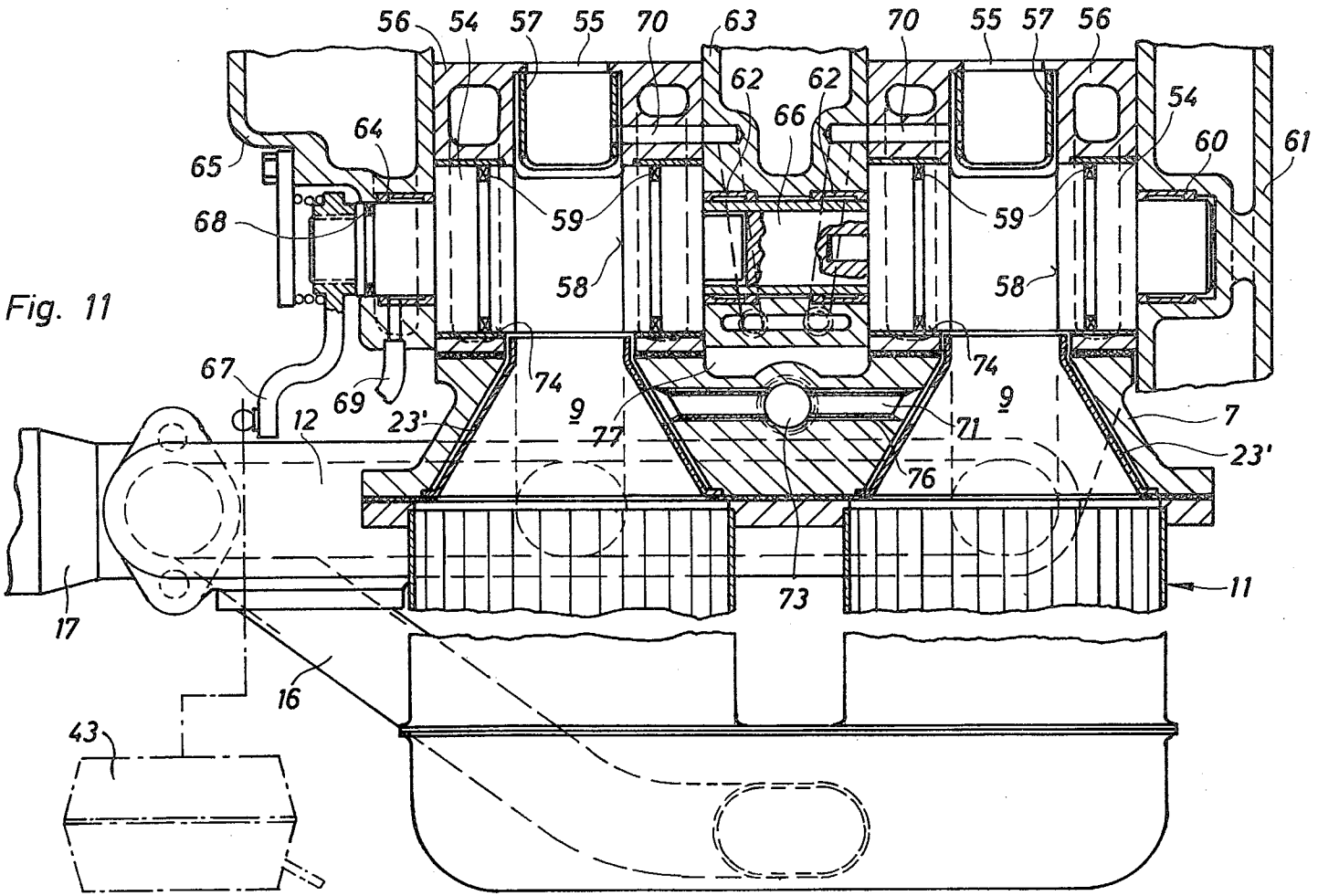
FIG. 11 shows a portion of a longitudinal section of the housing of a rotary piston internal combustion engine taken along the line XI—XI in FIG. 10.

FIG. 11 shows the mounting or accommodation of a rotary slide 54 in each jacket of a rotary piston engine having two housings 56. The rotary slide 54, secured against rotation by a pin 66, is mounted on a sinter bearing 60 in an end piece 61 of housing 56 and two sinter bearings 62 accepting pin 66 in the middle wall 63 and a sinter bearing 64 in end piece 65. The rotary slides 54 are connected by way of the slide journals passing out through end piece 65 to an actuating lever 67 actuated in turn by a temperature control 43 and transmitting the rotation. To avoid escape of exhaust gas, each rotary valve slide 54 is sealed off on its cylindrical periphery from housing 56 inside the cylindrical aperture 74 by sealing rings 59, which may, for example, be ordinary commercial piston rings. The sinter bearing 64, likewise sealed off from the atmosphere by another sealing ring 68, is adjoined by a vent line 69 through which any escaping exhaust may, for example, be carried off to the engine air filter, not shown. The passages 70 are intended to supply secondary air to outlet passage 55, while passages 71 and 72 in housing 7 establish communication, as further described with reference to FIGS. 12 and 13, which a lambda probe 75 arranged in a well 73.

Figure 13:
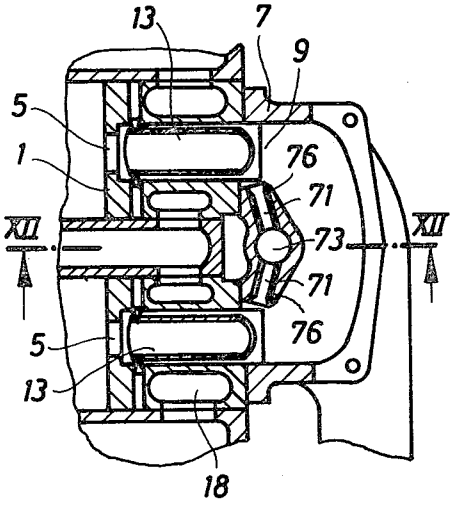
FIG. 13 shows a portion of a longitudinal section of the housing taken along the line XIII—XIII in FIG. 12.
Figure 12:
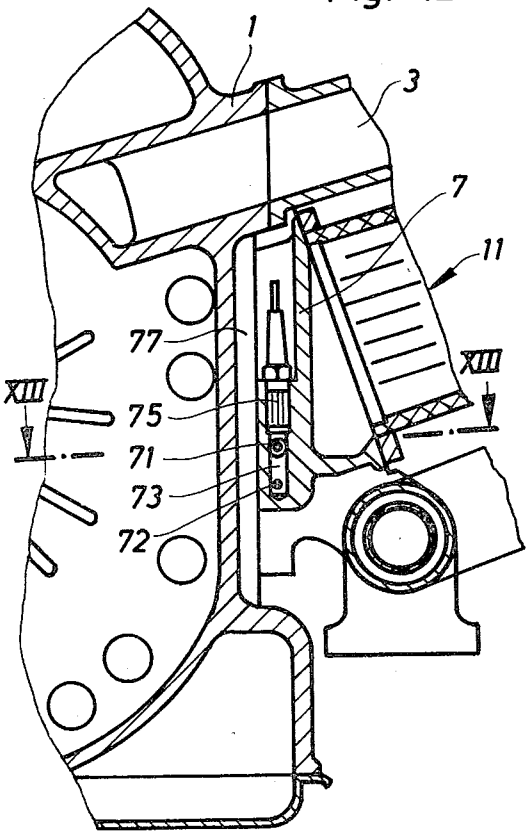
FIG. 12 shows a cross-section of a portion of the housing of a rotary piston internal combustion engine in the region of the exhaust probe, taken along the line XII—XII in FIG. 13.

FIGS. 12 and 13, in which like and similar parts are designated by the same numerals as in the preceding embodiments show the arrangement of a lambda probe 75 advantageously able to sense the composition of the exhaust in close proximity to the outlet passages 5. For this purpose, the housing 7 of afterburner 11, immediately adjacent to housing 1, contains a well 73 communicating each by a passage 71 with opening 9 and by a passage 72 with opening 10, while the well 73 contains the lambda probe 75. In operation of the engine, depending on the setting of the control member, communication is established either from opening 9 by way of passage 71, well 73 and passage 72 to opening 10, or vice versa, so that some of the exhaust flow always enters well 73 and bathes the probe. The portion of the exhaust passing over the probe is so small, owing to the cross-sectional area of passages 71 and 72, that in the mode where the exhaust flow passes through by-pass 12, it can have no adverse effects on the afterburner 11. To avoid cooling of the exhaust on the wall of passage 71 also, during a cold start, the latter passage 2 may be fitted with a heat-insulating tube 76. So that the lambda probe will not be exposed to undue heating, an open ventilating passage 77 is provided between housing 7 and housing 1 in the region of the probe 75.

Thus the several aforenoted objects and advantages are most effectively attained. Although several somewhat preferred embodiments have been disclosed and described in detail herein, it should be understood that this invention is in no sense limited thereby and its scope is to be determined by that of the appended claims.

What is claimed is:

1. An internal combustion engine having at least one outlet passage for the exhaust of burned gases, terminating at the exterior surface of the engine and capable of being placed in communication alternatively with an afterburner and with a by-pass by-passing the afterburner, a temperature regulated control member passing the burned gases through the by-pass at high temperature and through the afterburner at low temperature, a housing being arranged on the exterior surface of the engine in the region of the outlet passage, the housing have two openings in its surface adjacent to the engine, one of which openings communicates directly with the afterburner and the other opening with the by-pass, the outlet passage widening in the direction of flow towards the exterior surface so that it encloses the openings, and the control member being arranged pivotally in the outlet passage so that it connects the outlet passage exclusively with the one opening in its first position and exclusively with the other opening in its second position.

2. An engine according to claim 1, wherein the control member is comprised of a tubular insert.

3. An engine according to claim 2, wherein the tubular insert is mounted on conical bearings at its pivot and connected at a distance from its pivot to a linkage capable of being actuated by a shaft mounted in the engine housing by way of a lever.

4. An engine according to claim 3, wherein at least one of the linkage and the shaft is arranged in the region of the cooling jacket of the engine.

5. An engine according to claim 3, wherein the shaft is arranged in the housing of the engine above the tubular insert.

6. An engine according to claim 3, wherein the connection between the lever and the linkage includes a spring element.

7. An engine according to claim 6, wherein the spring element includes a spring bolt connected by either end to one of the levers and the linkage and by the middle portion to one of the linkage and to the lever.

8. An engine according to claim 3, wherein the lever is connected to the linkage by a pin guided in an oblong hole, the pin bearing against the ends of the oblong hole by one spring means arranged near the two ends of the oblong hole.

9. An engine according to claim 1, wherein the control member is comprised of a flap mounted between the two openings and extending into the outlet passage.

10. An engine according to claim 9, wherein the flap is fixed on the shaft mounted in the housing arranged on the exterior surface of the engine.

11. An engine according to claim 1, wherein the control member is comprised of a rotary slide mounted in the housing between the two openings.

12. An engine according to claim 1, wherein the housing containing the afterburner is fitted between the one opening and the afterburner with an insulating insert forming a cavity with the wall of the housing.

13. An engine according to claim 1, wherein a baffle directed at the center of the afterburner is arranged in the housing containing the afterburner, between the opening and the afterburner, said baffle dividing the afterburner into two halves with opposed directions to flow and bounds both the opening leading to the afterburner and the exhaust line opening into the by-pass and leading out of the second half of the afterburner.

14. An engine according to claim 1, wherein the openings are connected by a passage in which a lambda probe is arranged.

* * * * *

UNITED STATES PATENT AND TRADEMARK OFFICE

CERTIFICATE OF CORRECTION

PATENT NO. : 4,215,538

DATED : August 5, 1980

INVENTOR(S) : Johannes Steinwart et al

It is certified that error appears in the above—identified patent and that said Letters Patent is hereby corrected as shown below:

Column 1, line 57, "While" should be --With--;

Claim 13, column 10, line 2, "to" should be --of--.

Signed and Sealed this

*Twenty-fifth* Day of *November 1980*

[SEAL]

*Attest:*

SIDNEY A. DIAMOND

*Attesting Officer*

*Commissioner of Patents and Trademarks*